US006276539B1

(12) United States Patent
Richbourg

(10) Patent No.: US 6,276,539 B1
(45) Date of Patent: Aug. 21, 2001

(54) GARAGE DOOR MOUNTED ROD AND REEL HOLDER

(75) Inventor: Tommy Jack Richbourg, Conroe, TX (US)

(73) Assignee: USA J&J Enterprises, Inc., Chappell Hill, TX (US)

( * ) Notice: Subject to any disclaimer, the term of this patent is extended or adjusted under 35 U.S.C. 154(b) by 0 days.

(21) Appl. No.: 09/697,818

(22) Filed: Oct. 26, 2000

(51) Int. Cl.[7] ..... A47F 7/00

(52) U.S. Cl. ..... 211/70.8; 211/85.7; 211/86.01; 160/327; D6/552

(58) Field of Search ..... 211/70.8, 70.6, 211/87.01, 86.01, 60.1, 85.7; 160/127; D6/552

(56) References Cited

U.S. PATENT DOCUMENTS

D. 226,051 * 1/1973 Fujinami .
D. 272,785 * 2/1984 Rumbaugh .
D. 272,787 2/1984 Rumbaugh .
D. 273,647 * 5/1984 Kandarian .
D. 345,273 * 3/1994 Horn ..... D6/552
D. 378,482 * 3/1997 Hall et al. ..... D6/552
3,291,427 * 12/1966 Hutchings .
4,961,505 * 10/1990 Moeller ..... 211/70.8
5,036,899 * 8/1991 Mullet .
5,678,700 10/1997 Crosson, Jr. .
5,979,102 * 11/1999 Sagryn ..... 211/70.8 X

* cited by examiner

*Primary Examiner*—Robert W Gibson, Jr.
(74) *Attorney, Agent, or Firm*—Mary J. Gaskin

(57) ABSTRACT

A rod and reel holder which comprises three brackets which are mounted on the inside of a garage door. As many as eight fishing rods and reels can be stored, in a horizontal position, on each holder, which occupies otherwise wasted "wall" space, that is, the inside panels of a garage door.

6 Claims, 3 Drawing Sheets

GARAGE DOOR MOUNTED ROD AND REEL HOLDER

FIELD OF THE INVENTION

The present invention relates to a holder, or rack, for storing a number of fishing rods and reels, using the inside of a garage door for support.

BACKGROUND OF THE INVENTION

The prior art provides a variety of support structures for holding or storing fishing rods and reels; some store the rods in a horizontal position, other in a vertical position. With both orientations, the support structures, which hold rods and reels, use up valuable wall space. In addition, due to various design deficiencies, rods and reels often can be knocked off some of the presently-used holders or can become entangled. Some holders require disassembly or mechanical movements before rods and reels can be stored.

SUMMARY OF THE INVENTION

The present invention consists of three flat rectangular brackets—two end brackets and a middle bracket. Each of the end brackets has either four or three circular holes The middle bracket has either eight or six circular holes, depending on the number of holes in the corresponding end brackets. The brackets are mounted onto the back of a garage door, thereby utilizing the otherwise unused space on the flat panels of a garage door. As many as eight rods and reels can be stored in a horizontal position on the brackets with four/eight/four circular holes; up to six rods and reels can be stored on the brackets with three/six/three circular holes. No disassembly is required before the rods and reels are stored.

It is an object of the present invention to organize and store multiple fishing rods and reels until they are ready to use.

Another object of the present invention is to provide a rack for storing as many as six to eight rods and reels parallel to each other, thereby preventing entanglement.

A further object of the present invention is to provide a holder for fishing rods and reels which is economical to manufacture, using a minimal amount of material.

Yet another object of the present invention is to provide a holder for fishing rods and reels which is easy to install, with predrilled holes, and which is easy to use.

Still another object of the present invention is to utilize otherwise unused storage space, namely the inside surface of a garage door.

A still further object of the present invention is to provide a holder which stores fishing rods and reels in a horizontal position to prevent moisture from collecting thereon.

An additional object of the present invention is to provide a holder which keeps rods and reels from being knocked loose or from falling out therefrom.

BRIEF DESCRIPTION OF THE DRAWINGS

FIG. 2A is a side view of a support bracket with holes for holding the butt ends of rods and reels.

FIG. 2B is a side view of a support bracket with holes for holding the tip ends of rods and reels.

FIG. 2C is identical to FIG. 2A.

DESCRIPTION OF THE PREFERRED EMBODIMENT

Figure 1:
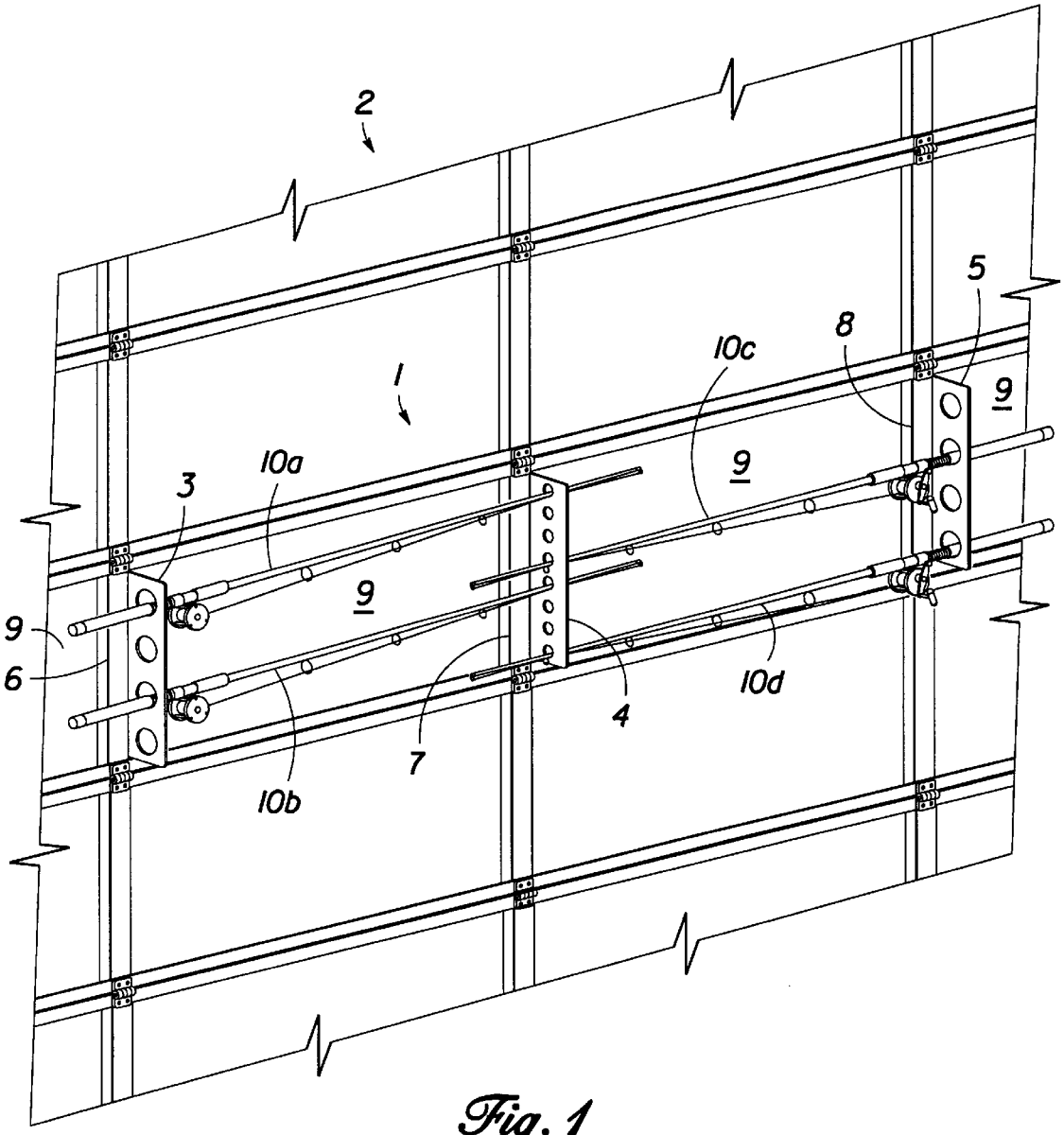
FIG. 1 is a front perspective view of the rod and reel holder, affixed to a garage door and holding several rods and reels.

FIG. 1 shows the rod and reel holder 1 of the present invention attached to a metal garage door 2. The rod and reel holder 1 comprises a first side bracket 3, a center bracket 4, and a second side bracket 5. The first side bracket 3 is mounted on first garage door stile 6; the center bracket 4 is mounted on second garage door stile 7; and the second side bracket 5 is mounted on third garage door stile 8. The back edges of the brackets 3, 4, 5 typically rest against garage door panel 9. Stored on the rod and reel holder 1 are rod and reels 10*a*, 10*b*, 10*c*, 10*d*.

Figure 2A:
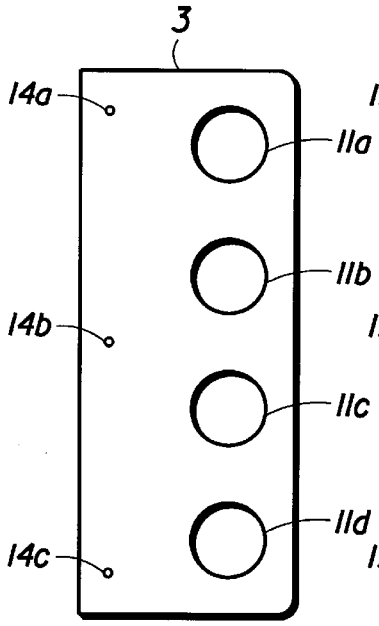
FIGS. 2A, 2B, 2C show the three brackets which will be installed onto a garage door.
Figure 2B:
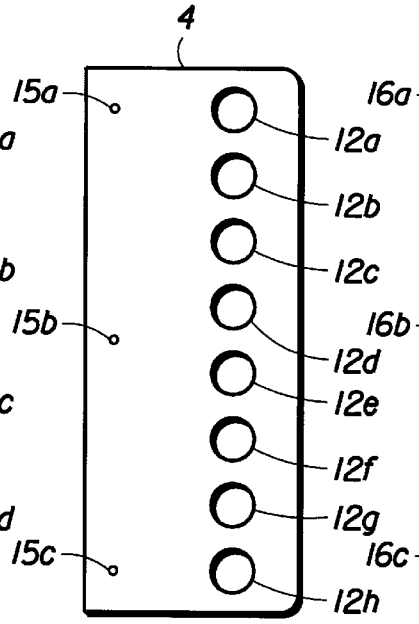
Figure 2C:
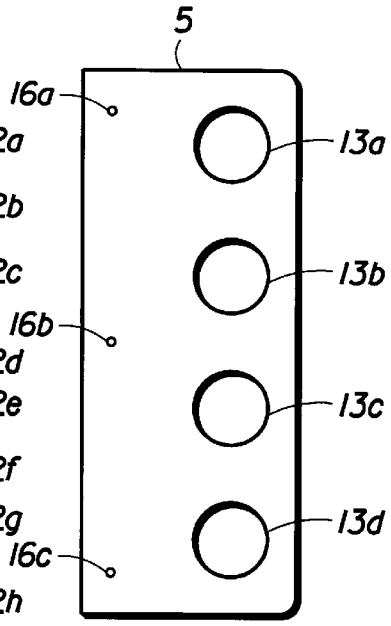

FIGS. 2A, 2B, and 2C show the flat brackets 3, 4, 5, which are made from a sturdy material, such as plastic resin, i.e., polylac® ABS Resin by Calsak Corporation, wood, plexiglass, or metal such as aluminum. Each bracket can be formed in a mold or can be shaped with cutting instruments. The brackets 3, 4, 5 are sized to have a height somewhat less than the height of a garage door panel, and to have a width large enough to hold a rod and reel, but narrow enough not to interfere with the placement of a car in the garage. In these figures, the brackets shown are approximately 6.5 inches wide by 16.5 inches high by 0.125 inches deep. The first side bracket 3 in FIG. 2A has circular holes 11*a*, 11*b*, 11*c*, 11*d* for insertion of the butts of rods and reels. Here the holes are approximately 2 inches in diameter Predrilled holes 14*a*, 14*b*, 14*c* are used for insertion of mounting screws. The center bracket 4 in FIG. 2B has smaller circular holes 12*a*, 12*b*, 12*c*, 12*d*, 12*e*, 12*f*, 12*g*, 12*h* for insertion of the tips of rods and reels. Here the holes are approximately 1.5 inches in diameter. Predrilled holes 15*a*, 15*b*, 15*c* are used for insertion of mounting screws. The second side bracket 5 in FIG. 2C is identical to the first side bracket 3 in FIG. 2A, with circular holes 13*a*, 13*b*, 13*c*, 13*d* for insertion of the butts of rods and reels. Predrilled holes 16*a*, 16*b*, 16*c*, are used for insertion of mounting screws. When the brackets 3, 4, 5 are used for storing rods and reels, each large circular hole shown in FIGS. 2A and 2C is used with one of two corresponding smaller circular holes shown in FIG. 2B. For example, one of the large circular holes such as 11*a*, would hold the butt of a rod and reel, while its tip would be inserted into either smaller circular hole 12*a* or 12*b* of FIG. 2B. A second fishing rod could have its butt held in circular hole 13A of FIG. 2C, with its tip inserted into whichever of smaller circular holes 12*a*, 12*b* of FIG. 2B remains unused. Although the brackets shown in FIGS. 2A and 2C have four circular holes, and the bracket in FIG. 2B has eight circular holes, the invention may also be practiced with side brackets having three circular holes and a center bracket with six circular holes.

Figure 3:
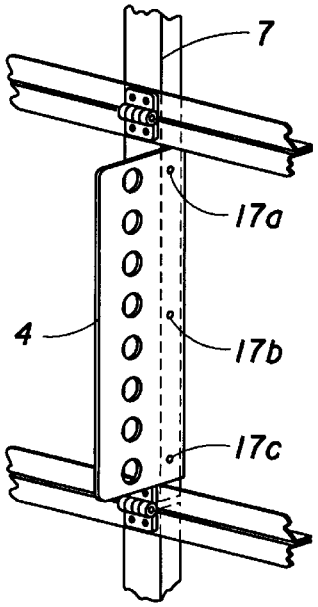
FIG. 3 is a perspective view of the bracket in FIG. 2B, after it has been attached to a stile of a garage door.

In FIG. 3, a center bracket 4 such as that shown in FIG. 2B has been mounted onto the side of a garage door stile 7, using self-tapping, sheet metal screws 17*a*, 17*b*, 17*c*. The side brackets are mounted to adjacent garage door stiles in similar fashion.

Figure 4:
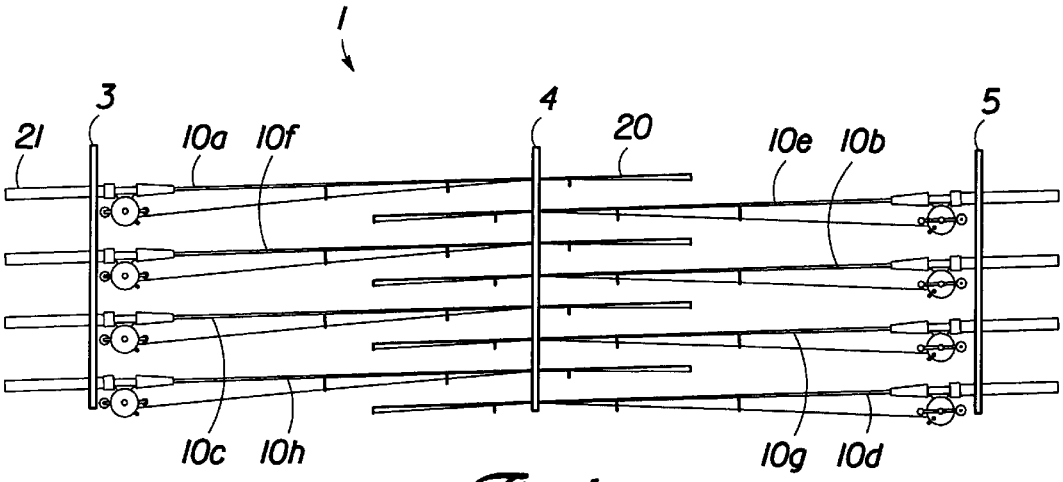
FIG. 4 is a front view of he three support brackets, as installed, holding the maximum number of eight rods and reels.
Figure 5:
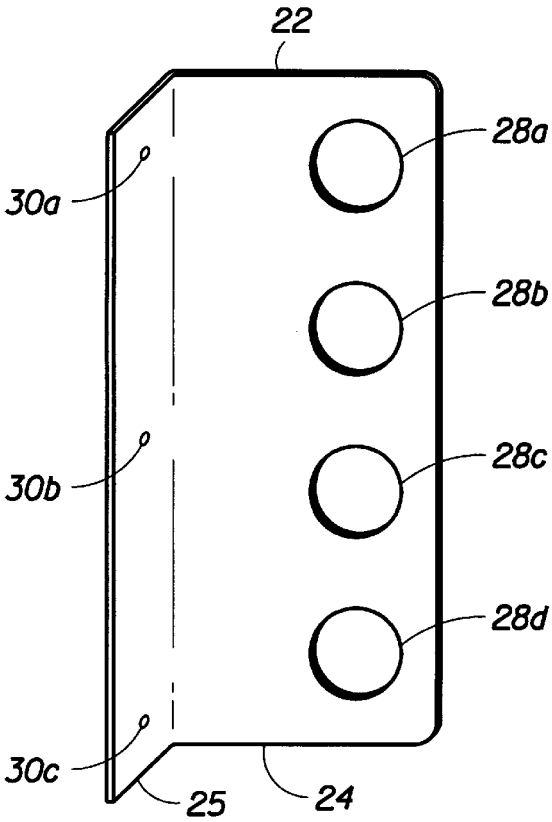
FIG. 5 is another embodiment of a support bracket with holes for holding the butt ends of rods and reels, with an angled portion for attachment to a wooden garage door.
Figure 6:
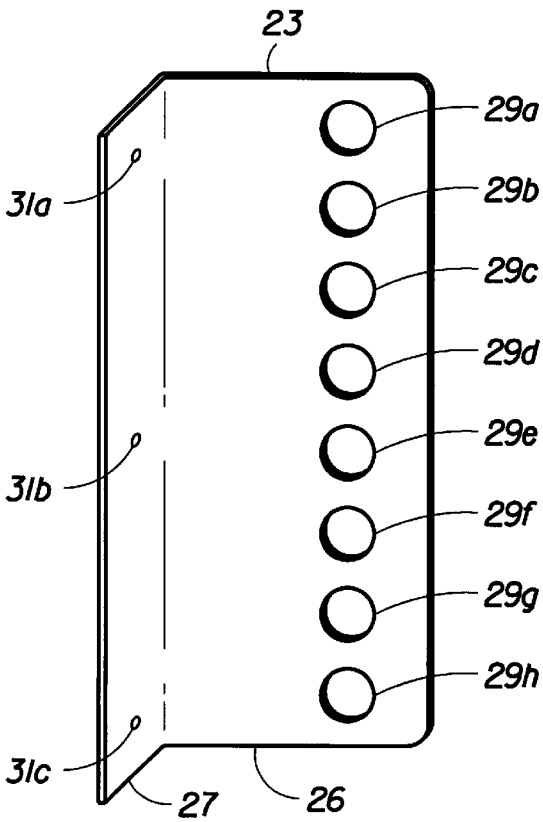
FIG. 6 is another embodiment of a support bracket with cut-out holes for holding the tip ends of rods and reels, with an angled portion for attachment to a wooden garage door.

FIG. 4 shows eight rods and reels 10*a*, 10*b*, 10*c*, 10*d*, 10*e*, 10*f*, 10*g*, 10*h*, supported by the present invention 1, comprising first side bracket 3, center bracket 4, and second side bracket 4. In using the present invention 1, one would place the tip 20 of a rod and reel 10*a* through a hole in the center bracket 4, then put the butt 21 of the rod and reel 10*a* through a corresponding hole in the first side bracket 3. The brackets are light enough that, even a fully-loaded holder does not in any way interfere with the operation of the garage door.

Another embodiment of the present invention, which can also be used on wooden garage doors, uses two side brackets 22 and a center bracket 23. Each side bracket 22 has a flat portion 24 with circular holes 28*a*, 28*b*, 28*c*, 28*d*, as well as a mounting portion 25 formed at a 90° angle to the flat portion 24. The mounting portion 25 typically has predrilled holes 30*a*, 30*b*, 30*c* for insertion of mounting screws. Similarly, the center bracket 23 has a flat portion 26 with circular holes 29*a*, 29*b*, 29*c*, 29*d*, 29*e*, 29*f*, 29*g*, 29*h*, as well as a mounting portion 27 formed at a 90° angle to the flat portion 26. The mounting portion 27 typically has predrilled holes 31*a*, 31*b*, 31*c* for insertion of mounting screws.

A preferred embodiment of the present invention has been described herein, but it will be understood by those skilled in the art that various changes in form may be made without departing from the spirit and scope of the claimed invention as defined in the appended claims.

I claim:

1. A fishing rod and reel holder which comprises:

a flat, rectangular first bracket having a width and a length, and further having a plurality of openings, each opening adapted to receive a butt end of a fishing rod, said openings spaced equidistant from each other in a row parallel to the length;

a flat, rectangular second bracket having a width and a length, and further having a plurality of openings, in a quantity being double in number to the quantity of openings of the first bracket, each opening adapted to receive a tip end of a fishing rod, said openings spaced equidistant from each other in a row parallel to the length;

a flat, rectangular third bracket identical to the first bracket;

a garage door panel with at least three stiles;

means for mounting each of the brackets on one of the stiles, the brackets being arranged in horizontal alignment, with the second bracket disposed between the first bracket and the third bracket, and with the widths of the brackets perpendicular to the garage door panel and the lengths of the bracket perpendicular to a horizontal plane.

2. The fishing rod and reel holder of claim 1 wherein each of the brackets has at least three predrilled holes, and the mounting means comprises screws which are threaded through said holes and into the garage door panel.

3. The fishing rod and reel holder of claim 1 wherein the first bracket has four openings, and the second bracket has eight openings, and the third bracket has four openings.

4. The fishing rod and reel holder of claim 1 wherein the first bracket has three openings, the second bracket has six openings, and the third bracket has three openings.

5. The fishing rod and reel holder of claim 1, wherein said holder is fabricated from a sturdy material selected from the group consisting of plastic resin, wood, plexiglass, and metal.

6. The fishing rod and reel holder of claim 1 wherein each bracket has a main portion and a side portion, said side portion being configured to form a 90° angle with the main portion, said side portion further having at least three predrilled holes, and the mounting means comprises screws which are threaded through said holes and into the garage door panel.

* * * * *